United States Patent [19]

Giebel et al.

[11] Patent Number: 4,688,288

[45] Date of Patent: Aug. 25, 1987

[54] PULLING OVER AND TOE LASTING MACHINE

[75] Inventors: Gerhard Giebel, Bad Soden; Manfred Bröning, Frankfurt am Main; Rudi Fichtner, Rossbach, all of Fed. Rep. of Germany

[73] Assignee: USM Corporation, Flemington, N.J.

[21] Appl. No.: 885,105

[22] Filed: Jul. 14, 1986

[30] Foreign Application Priority Data

Jul. 16, 1985 [DE] Fed. Rep. of Germany ..... 3525368

[51] Int. Cl.[4] ..... A43D 23/00; A43D 21/16

[52] U.S. Cl. ..... 12/14.5; 12/10.1; 12/12.2

[58] Field of Search ..... 12/8.5, 8.7, 8.8, 10.1, 12/11.3, 12.2, 14.5

[56] References Cited

U.S. PATENT DOCUMENTS

| | | | |
|---|---|---|---|
| 3,025,541 | 3/1962 | Weinschenk | 12/14.5 |
| 3,451,083 | 6/1969 | Pedretti | 12/11.3 |
| 4,173,050 | 11/1979 | Vornberger | 12/14.5 |
| 4,240,172 | 12/1980 | Garner | 12/14.5 |
| 4,499,622 | 2/1985 | Garner | 12/14.5 |

FOREIGN PATENT DOCUMENTS

| | | | |
|---|---|---|---|
| 2748229 | 11/1978 | Fed. Rep. of Germany | 12/14.5 |
| 2105572 | 3/1983 | United Kingdom | 12/12.2 |

*Primary Examiner*—Henry S. Jaudon
*Assistant Examiner*—Steven N. Meyers

[57] ABSTRACT

In a pulling over and lasting machine in addition to a toe pincer there are provided two sets of side pincers, each set being mounted on a support pivotal about an axis extending heightwise of the shoe bottom and passing through or adjacent the toe pincer. Each pincer is adjustably mounted on its support but in addition each set is movable bodily, through its support, about its axis. The supports are movable equidistantly in opposite directions, i.e. towards and away from one another, into a selected one of a plurality of pre-set positions thus to accommodate to shoes of different widths. For moving the supports a plurality of cylinders are arranged in tandem and operable according to the selected pre-set position of the support.

4 Claims, 2 Drawing Figures

PULLING OVER AND TOE LASTING MACHINE

BACKGROUND OF THE INVENTION

This invention is concerned with pulling over and toe lasting machines comprising shoe support means for supporting, bottom down, a shoe comprising an upper on a last and an insole on the last bottom, a plurality of pincers including at least one toe pincer and two sets of side pincers, the pincers being arranged in a generally U-shape about the shoe support means for gripping lasting marginal portions of the shoe upper and tensioning the upper about its last, and a wiper assembly by which lasting marginal portions of the upper tensioned as aforesaid are wiped over and pressed against corresponding marginal portions of the insole, the assembly comprising two wiper plates disposed symmetrically at opposite sides of the longitudinal center line of the operating locality of the machine.

Machines of the aforementioned type are generally well known and conventional, see e.g. GB-A No. 2114868. Furthermore, in order to be able to accommodate the side pincers to different shoe widths, in machines of the aforementioned type each pincer is mounted for individual adjusting movement relative to the shoe support both lengthwise and widthwise of the bottom of a shoe supported thereby, thus to enable the operator to adjust the position of the pincers to the particular size and style of shoe being operated upon. In practice, however, it has been found that the operator tends to set the side pincers merely to the shape of the largest shoe in order to avoid the time-consuming individual adjustment of the side pincers in order to accommodate smaller shoes. Such a practice, however, does not enable the best lasting results to be obtained from the machine.

It has been proposed in GB-A No. 871990 to allow the pincers to move individually, i.e. independently of one another, from an outwardly spaced position inwardly to a position determined by engagement with the shoe bottom periphery of an abutment associated with each pincer, thereby setting the position of each pincer automatically according to the periphery of the shoe bottom. This arrangement however leads to an expensive machine construction which cannot be considered to be justified in terms of enhanced performance.

Furthermore, it is proposed in US-A No. 1441210 to provide, in a pulling over machine, a toe pincer and two side pincers arranged one at each side of the toe pincer, the side pincers each being mounted on a swinging arm the axis of rotation of which extends approximately vertically to the shoe bottom, one at each side of the toe pincer, and locking means being provided for securing each arm in adjusted position. In this way, the operator can readily re-position each pincer, thus to accommodate two shoes of different widths. With this arrangement however, the swinging of the arm provides the only adjustment of each pincer; that is to say the pincer is not adjustable relative to the arm. Consequently such an arrangement would not be suitable for incorporation into currently available pulling over and lasting machines, where more than one pincer would have to be mounted on each arm and be adjustable to accommodate different styles of shoe. Furthermore, even if such an arrangement were used, it could be expected that adjustment by the operator would be made only infrequently, as is the current practice (see above).

OBJECT OF THE INVENTION

It is thus the object of the present invention to provide an improved pulling over and toe lasting machine of the aforementioned type, wherein the side pincers can be positioned independently of one another according to the style of the shoe being operated upon, while maintaining a closed pincer formation, but also each set of side pincers is movable in a predetermined way in order to be positioned more appropriately to the particular shoe being operated upon.

SUMMARY OF THE INVENTION

The invention thus provides a pulling over and toe lasting machine comprising shoe support means for supporting, bottom down, a shoe comprising an upper on a last and an insole on the last bottom, a plurality of pincers including at least one toe pincer and two sets of side pincers, the pincers being arranged in a generally U-shape about the shoe support means for gripping lasting marginal portions of the shoe upper and tensioning the upper about its last, and a wiper assembly by which lasting marginal portions of the upper tensioned as aforesaid are wiped over and pressed against corresponding marginal portions of the insole, wherein each set of side pincers is supported on a support mounted for pivotal movement about an axis extending heightwise of the shoe bottom and passing through or adjacent the toe pincer(s), and further wherein drive means is provided, operatively connected to each of the side pincer supports, for moving the supports relative to a longitudinal centerline of the operating locality of the machine through equal distances but in opposite directions (i.e. towards or away from each other) thus to accommodate to shoes of different sizes.

It will thus be appreciated that in accordance with the invention, by means of a single setting, the two sets of side pincers, on their supports, can be moved bodily to accommodate to the size of the shoe being operated upon.

In one embodiment of the invention the drive means acts on a support member to which are connected two linkages which are also operatively connected one to each of the side pincer supports; conveniently such linkages are constituted by Bowden cables. In this way, by a relatively simple arrangement, which can in fact be remote from the operating locality of the machine, by reason of the use of the Bowden cables, the sets of side pincers can be bodily adjusted to accommodate to shoes of different sizes.

The drive means of the machine in accordance with the invention is preferably arranged for moving the support selectively between a plurality of pre-set positions. To this end, the drive means conveniently comprises a single motor arrangement, the arrangement comprising a plurality of piston-and-cylinder arrangements mounted in tandem. In this way, by selectively operating the piston-and-cylinder arrangements, a plurality of pre-set positions for the supports for the pincers can be selected. The machine also comprises selecting means for this purpose.

It will thus be appreciated that, in using the machine in accordance with the present invention, the operator can, without the need for setting stops or the like, selectively position the sets of side pincers according to shoe size, such selection requiring a minimum of operator time and effort.

There now follows a detailed description, to be read with reference to the accompanying drawings. It will be appreciated that this machine now to be described has been selected for description merely to illustrate the invention in its several aspects by way of a non-limiting example.

DESCRIPTION OF THE PREFERRED EMBODIMENT

Figure 1:
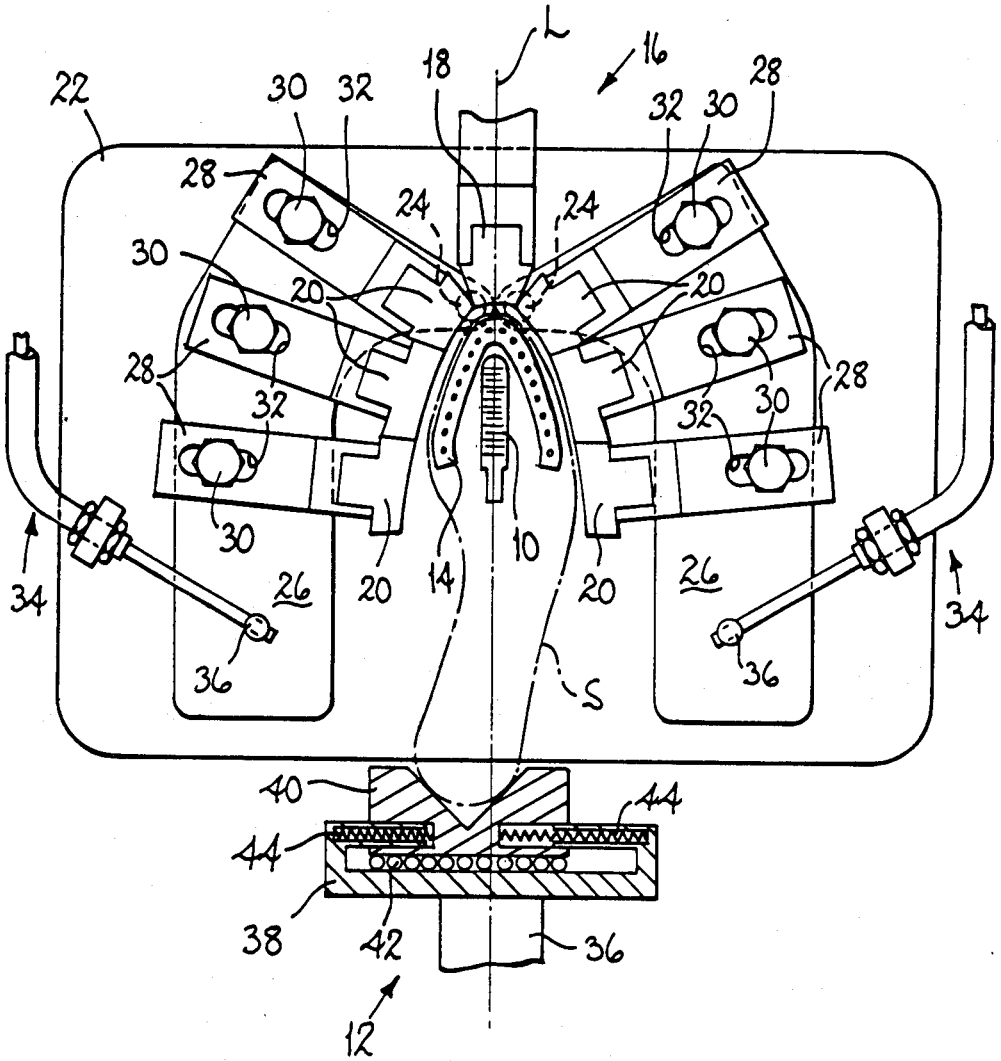
FIG. 1 is a fragmentary plan view showing details of a pincer arrangement of the machine now to be described.

The machine now to be described is a pulling over and toe lasting machine comprising a shoe support comprising a toe support 10 and a heel rest generally designated 12 for supporting, bottom down, a shoe S comprising an upper on a last and an insole of the last bottom. An auxiliary shoe support function is also afforded by an adhesive-applying nozzle 14 which is generally U-shaped for applying a strip of adhesive about the toe and forepart end of the shoe bottom prior to lasting taking place. The machine also comprises a pincer assembly generally designated 16, comprising a toe pincer 18 and a plurality of (in this case six) side pincers 20 arranged in two sets, each of three, at opposite sides of the shoe support, as will be hereinafter described in detail. The pincers are arranged in a generally U-shape about the shoe support for gripping lasting marginal portions of the shoe upper and tensioning the upper about its last. Furthermore, the machine also comprises a wiper assembly (not shown) by which lasting marginal portions of the upper tensioned as aforesaid are wiped over and pressed against corresponding marginal portions of the insole. The wiper assembly comprises two wiper plates disposed symmetrically at opposite side of the longitudinal centreline L of the operating locality of the machine.

The pincer assembly 16 comprises a base plate 22 on which the toe pincer 18 is supported (in a conventional manner, not shown herein) for heightwise movement whereby to tension, in a direction lengthwise of its last, a shoe upper gripped thereby. Also mounted on the base plate 22, for pivotal movement each about an axis 24 extending heightwise of the base plate, are two support plates 26. The axes 24 are arranged one at either side of the toe pincer 18 and pass through the jaws of the pincer 18 at the corners formed at opposite ends of the leading edge thereof (see FIG. 1). Mounted on each support plate 26 is one of the sets of side pincers 20, each pincer being supported by a block 28 clamped to its support plate 26 by a clamp screw 30, whereby upon release of the latter each pincer can be positioned relative to the support plate 26 and to its neighbouring side pincers 20. Such adjustment may be pivotal about the clamp screw 30 or lengthwise of the block 28 (by means of the slot 32 provided therein); however, as is conventional in pulling over and lasting machines, such adjustment of the pincers should be such that (as shown in FIG. 1) leading edges of the jaws thereof form a continuous line. Furthermore, desirably the leading edges of the pincers adjacent the toe pincer 18 should form a continuous line therewith such that the corner adjacent the toe pincer also lies on the axis 24 for its associated support plate 26. The side pincers are also mounted for heightwise movement to tension the upper about its last in a conventional manner.

Each support plate 26 is mounted for pivotal movement about its axis 24, thus to move its associated set of side pincers 20 thereabout. For moving the support plates 26 under control, linkages constituted by Bowden cables generally designated 34 are provided, one attached to each plate at a point 36 remote from the axis 24. The manner in which the Bowden cables are operated will be described in detail hereinafter.

The heel support 12 of the machine comprises a support bracket 36 supporting a housing 38 in which a V-block 40 is movable transversely of the longitudinal centerline L of the operating locality. For reducing friction which may inhibit such transverse movement, a row of ball bearings 42 is provided acting between a rearward face of the V-block 40 and an inner face of the housing 38. For centralising the V-block with the base of its V on the longitudinal centerline L, equalising springs 44 are provided in the housing and act on abutment surfaces provided on the V-block.

As can be seen from FIG. 1, when a shoe is supported with the longitudinal centerline of its toe end aligned with the longitudinal of the operating locality, the heel end is significantly offset from the centerline L. In order to provide proper support for the heel end and to hold it against the thrust of a toe band (not shown, but conventional in pulling over and lasting machines), the V-block can slide easily transversely to accommodate to the particular position of the heel end, without in any way applying transverse forces which would affect the orientation of the toe end of the shoe. It will also be appreciated that, with such a heel rest 12, it is unnecessary to pre-set end positions for accommodating left and right shoes.

Figure 2:
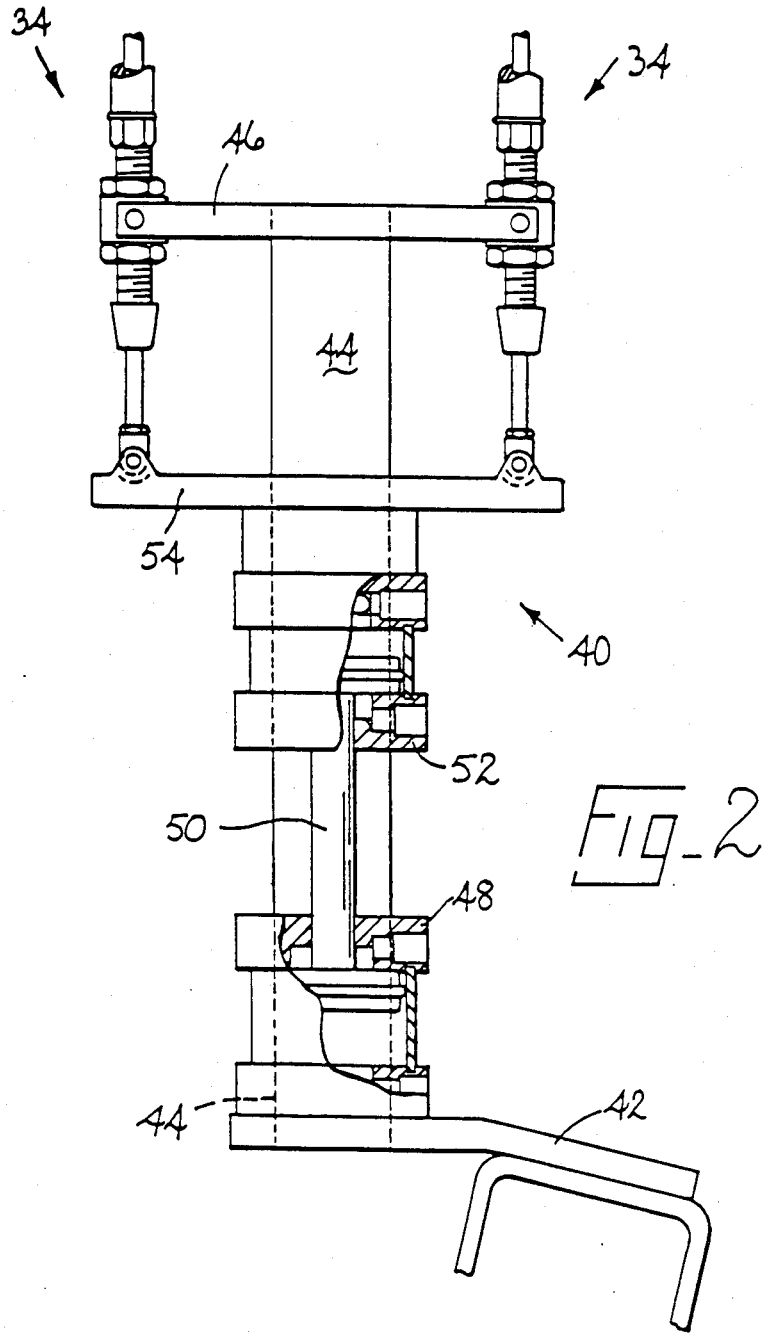
FIG. 2 is a fragmentary view showing details of drive means by which the sets of side pincers of the machine can be positioned according to the width of shoe being operated upon.

With reference to FIG. 2, the machine in accordance with the invention also comprises drive means generally designated 40 operatively connected to each of the support plates 26 through the Bowden cables 34. The drive means 40 is mounted at a location remote from the operating locality of the machine, this remote mounting being facilitated by the use of the Bowden cables 34. More particularly the drive means is mounted on a bracket 42 secured to a frame portion of the machine, the bracket supporting a support strap 44 on which a cross-bar 46 is carried which supports the sheath ends of the Bowden cables 34. Also mounted on the bracket 42 is a first piston-and-cylinder arrangement 48 having a piston rod 50 which is connected to a piston of a furtner piston-and-cylinder arrangement 52. The further arrangement 52 in turn supports a support member constituted by a cross-member 54 to which ends of the Bowden cables 34 are connected.

In the operation of the drive means 40, actuation of the piston-and-cylinder arrangement 48 is effective to move the piston-and-cylinder arrangement 52 bodily and the cross-member 54 therewith, thus through the Bowden cables 34 moving also the support plates 26. Similarly, actuation of piston-and-cylinder arrangement 52 serves also to move the cross-member 54 and the support plates 26 therewith. By using two piston-and-cylinder arrangements 48,52 which are of different dimensions, and thus of different stroke, it is possible using this tandem arrangement to achieve four separate pre-set positions of the cross-member 54.

It will be seen from FIG. 2 that upon actuation of either of the piston-and-cylinder arrangements 48,52 the ends of the cross-member 54 are moved equidistantly so that, through the Bowden cables 34, the support plates 26 are moved through equal distances also. Furthermore, the connection through the Bowden cables between the cross-member 54 and the support plates 26 is such that the latter move in opposite directions, i.e. towards or away from each other. Thus, the support plates 26, and also the sets of side pincers 20 supported thereby, can be positioned in one of four pre-set positions corresponding to the four positions of the drive means 40. Adjustment of the support plates 26 towards and away from each other, it will be appreciated, serves to fit the side pincers 20 to shoes of different sizes. It has been found that four pre-set positions are sufficient to accommodate adequately the types of shoe produced in one shoe factory.

Whereas in the machine described above the drive means 40 comprises fluid pressure operated motors in the form of piston-and-cylinder arrangements 48,52 other types of motor may be used, or indeed manual switching may be provided, without going outside the scope of this invention.

Furthermore, whereas in the machine described above two axes 24 are provided, one for each support plate 26, a single axis would be provided in other machines in accordance with the invention, the single axis supporting both support plates and being aligned centrally of the toe pincer arrangement.

We claim:

1. A pulling over and toe lasting machine comprising:

shoe support means for supporting, bottom down, a shoe upper having lasting marginal portions, a pincer assembly including a base plate, toe pincer means supported by said base plate and including a toe pincer having opposing sides and a gripping edge extending between and forming opposite corners with said pincer sides, first and second support plates, means for mounting said first support plate on said base plate for pivotal movement about a first axis extending through one of said corners, means for mounting said second support plate on said base plate for pivotal movement about a second axis, parallel to said first axis, extending through the other one of said corners, first and second pluralities of said pincer means, each including a gripping edge, means for supporting each of said first plurality of side pincer means on said first support plate for movement towards and away from the lasting marginal portion and for movement about a selected axis so that a selected continuous gripping surface can be defined with the gripping edges of said side pincer means and said toe pincer means, means for supporting each of said second plurality of side pincer means on said second support plate for movement towards and away from the lasting marginal portion and for movement above a selected axis so that a selected continuous gripping surface can be defined with the gripping edges of said side pincer means and said toe pincer means, said supporting means including fastening means for securing each of said side pincer means to its support plate, said fastening means for each of said side pincer means defining said selected axis of rotation for said side pincer means, and means for displacing said first and second support plates to displace said first and second pluralities of side pincer means conjointly towards or away from the lasting marginal portion while maintainig the continuous gripping edge defined by the gripping edges of said toe pincer means and said first and second plurality of side pincer means to therefore accommodate shoes of different sizes.

2. A machine according to claim 1, wherein said displacing means comprises means for displacing said first and second plates to one of a plurality of selected positions.

3. A machine according to claim 2, wherein said displacing means comprises a plurality of piston and cylinder arrangements mounted in tandem.

4. A machine according to claim 6, wherein said supporting means further includes an elongated slot in each of said first and second plurality of side pincer means through which its associated fastener means extends, said slots extending toward the lasting marginal portion.

* * * * *